US007690420B2

(12) United States Patent
Hörte

(10) Patent No.: US 7,690,420 B2
(45) Date of Patent: Apr. 6, 2010

(54) PLATE HEAT EXCHANGER

(75) Inventor: Tobias Hörte, Höllviken (SE)

(73) Assignee: Alfa Laval Corporate AB, Lund (SE)

( * ) Notice: Subject to any disclaimer, the term of this patent is extended or adjusted under 35 U.S.C. 154(b) by 949 days.

(21) Appl. No.: 10/581,351

(22) PCT Filed: Dec. 22, 2004

(86) PCT No.: PCT/SE2004/001976

§ 371 (c)(1),
(2), (4) Date: Jun. 1, 2006

(87) PCT Pub. No.: WO2005/066572

PCT Pub. Date: Jul. 21, 2005

(65) Prior Publication Data

US 2008/0283231 A1 Nov. 20, 2008

(30) Foreign Application Priority Data

Jan. 9, 2004 (SE) ..... 0400017

(51) Int. Cl.
*F28D 7/02* (2006.01)
*F28D 1/02* (2006.01)

(52) U.S. Cl. ..... 165/167; 165/153

(58) Field of Classification Search ..... 165/166, 165/167, 153, 165
See application file for complete search history.

(56) References Cited

U.S. PATENT DOCUMENTS 2,550,339 A * 4/1951 Ehrman ..... 165/167
2,617,634 A * 11/1952 Jendrassik ..... 165/140
3,444,926 A * 5/1969 Stalberg ..... 165/166
4,660,633 A * 4/1987 Fischer ..... 165/167
5,924,484 A * 7/1999 Andersson et al. ..... 165/167
5,971,065 A 10/1999 Bertilsson et al.
6,230,794 B1 5/2001 Bertilsson
2001/0030043 A1 * 10/2001 Gleisle et al. ..... 165/167

FOREIGN PATENT DOCUMENTS

| | | |
|---|---|---|
| DE | 3600656 | 7/1987 |
| EP | 1203193 | 9/2003 |
| JP | 2001-280888 | 10/2001 |
| SE | 502984 | 3/1996 |

OTHER PUBLICATIONS

International Search Report.

* cited by examiner

*Primary Examiner*—Tho V Duong
(74) *Attorney, Agent, or Firm*—Fish & Richardson P.C.

(57) ABSTRACT

A plate heat exchanger includes a number of first heat exchanger plates (A) and second heat exchanger plates (B). The plates include a first plate interspace (1) between each pair of adjacent plates (A) and (B), and a second plate interspace (2) between each pair of adjacent plates (B) and (A). The first and second plate interspaces are separated from each other and provided beside each other in an alternating order. The heat exchanger plates have a porthole, which forms an inlet channel (6) to the first plate interspaces. The plate heat exchanger includes a separate space (11) for each plate interspace. The space (11) is closed to the second plate interspaces. The space (11) communicates with the inlet channel via an inlet nozzle (13), which forms a throttling, and with the respective first plate interspace via an outlet nozzle (14), which forms a throttling.

22 Claims, 4 Drawing Sheets

PLATE HEAT EXCHANGER

THE BACKGROUND OF THE INVENTION AND PRIOR ART

The present invention refers generally to a plate heat exchanger, in particular a plate heat exchanger in the form of an evaporator, i.e. a plate heat exchanger designed for evaporation of a cooling agent in a cooling agent circuit for various applications, such as air conditioning, cooling systems, heat pump systems, etc.

The present invention refers especially to a plate heat exchanger, including a plate package, which includes a number of first heat exchanger plates and a number of second heat exchanger plates, which are permanently joined to each other and arranged beside each other in such a way that a first plate interspace is formed between each pair of adjacent first heat exchanger plates and second heat exchanger plates and a second plate interspace between each pair of adjacent second heat exchanger plates and first heat exchanger plates, wherein the first plate interspaces and the second plate interspaces are separated from each other and provided beside each other in an alternating order in the plate package, wherein substantially each heat exchanger plate has at least a first porthole and a second porthole, wherein the first portholes form a first inlet channel to the first plate interspaces and the second portholes form a first outlet channel from the first plate interspaces and wherein the plate package includes a separate space for each of said first plate interspaces, which space is closed to the second plate interspaces.

The cooling agent supplied to the inlet channel of such a plate heat exchanger for evaporation of the cooling agent is usually present both in a gaseous state and a liquid state. It is then difficult to provide an optimum distribution of the cooling agent to the different plate interspaces in the evaporator in such a way that an equal quantity of cooling agent is supplied and flows through each plate interspace. It is known that this problem of the distribution of the cooling agent at least partly can be solved by providing a throttling of the cooling agent at each plate interspace. In such a way a pressure drop of the cooling agent is obtained when it enters the respective plate interspace.

SE-C-502 984 discloses a plate heat exchanger of the kind initially defined having an inlet channel for a cooling agent. The inlet channel is through compression-moulding of the heat exchanger plates completely closed to the second plate interspaces for the fluid to be cooled and has a number of small openings extending to each of the first plate interspaces. These openings form throttlings, which provide a certain pressure drop of the cooling agent at the entrance into the respective plate interspace. The small openings may be designed as a hole through the sheet of each heat exchanger plate or as a thin channel provided through the compression-moulding.

U.S. Pat. No. 5,971,065 discloses a similar plate heat exchanger having a number of small openings between the inlet channel for the cooling agent and the respective plate interspace. The plate heat exchanger according to U.S. Pat. No. 5,971,065 differs from the solution proposed in the above-mentioned SE-C-502 984 in that a common space for the cooling agent has been created through the compression-moulding between the inlet channel and the respective plate interspace for the cooling agent. This common space extends through substantially the whole plate package in parallel to the inlet channel. A plurality of small openings extend between the inlet channel and the common space, and at least one small hole extends between the common space and each of the plate interspaces for the cooling agent.

EP-B-1 203 193 disclosed another plate heat exchanger including a package with heat exchanger plates, which together with sealing means defines first plate interspaces and second plate interspaces. The inlet channel is partly closed to the first plate interspaces by means of loose gaskets. The inlet channel communicates according to an embodiment disclosed with the first plate interspaces by means of small pipes extending through the respective gasket and forming a small opening for throttling of the cooling agent flow.

With the solutions proposed in these documents, it can be difficult to obtain a sufficient pressure drop for achieving an acceptable distribution of the cooling agent in the different first plate interspaces. In particular, a large pressure drop is required for cooling agents having a relatively high density in a gaseous state, for instance the cooling agent R410*a*. Another problem with the solutions proposed in these documents is that they can be difficult to apply to plate heat exchangers having small dimensions. In such small plate heat exchangers, there is not sufficient space around the inlet channel for the proposed solutions. In particular, the small channels provided through compression-moulding can tend to be clogged when the heat exchanger plates having a small mould depth of the thin channels are brazed to a plate package.

SUMMARY OF THE INVENTION

The object of the present invention is to provide an improved plate heat exchanger remedying the problems mentioned above. Especially it is aimed at a plate heat exchanger, which creates a sufficient pressure drop in a cooling agent at the entrance into the respective plate interspace.

A further object of the invention is to provide a plate heat exchanger, which may be manufactured with small dimensions.

This object is achieved by the plate heat exchanger initially defined, which is characterised in that said separate space communicates with the first inlet channel via an inlet nozzle, which forms a throttling with significantly reduced flow area, and with the respective first plate interspace via an outlet nozzle, which forms a throttling with significantly reduced flow area.

In its general form, the present invention thus defines two throttlings provided in series with each other and a separate space lying between the throttlings for each plate interspace. With such a flow path, an efficient total throttling may be achieved when a cooling agent enters the respective plate interspace in such a way that a sufficient pressure drop is ensured for achieving a uniform distribution of the cooling agent in all of the first plate interspaces. The separate spaces may in principal be provided in a substantially arbitrary position in the plate package. According to an advantageous embodiment of the invention, said separate space is, however, provided in the proximity of the inlet channel. Especially, these separate spaces may be provided around the inlet channel.

According to a further embodiment of the invention, said separate space has been produced through compression-moulding of the heat exchanger plates. In such a way, the plate package and the plate heat exchanger according to the invention may be manufactured in an easy and inexpensive manner.

According to a further embodiment of the invention, at least one of said nozzles is formed by a respective hole, which extends through each of said heat exchanger plates. Such a nozzle in the form of a hole may be provided in an easy manner from a manufacturing point of view. Such a hole also has the advantage that it may form an effective throttling and at the same time ensure that the nozzle remains open, for instance in connection with brazing of the plate package.

According to a further embodiment of the invention, the inlet nozzle is formed by a respective hole, which extends through each of said second heat exchanger plates. Furthermore, also the outlet nozzle may advantageously be formed by a respective hole, which extends through each of said second heat exchanger plates. Thereby, said separate space may be provided between a respective pair of adjacent second heat exchanger plates and first heat exchanger plates, i.e. said separate spaces are provided between the same pair of heat exchanger plates as the second plate interspaces.

According to a further embodiment of the invention, each of said heat exchanger plates includes a central extension plane, an upper plate plane on one side of the central extension plane and a lower plate plane on the other side of the central extension plane. Each of said second heat exchanger plates may then indude an upper surface area, which extends around said first porthole and which delimits said separate space, wherein the upper surface area is located at the level of the upper plate plane.

According to a further embodiment of the invention, the hole of the outlet nozzle extends through the upper surface area. The plate heat exchanger may then advantageously include an end plate, which is provided adjacent to one of said second heat exchanger plates in such a way that it closes the hole of the outlet nozzle of this second heat exchanger plate. This embodiment is especially advantageous since the outermost of said separate spaces will be sealed to the environment by means of a single, substantially plane end plate abutting said second heat exchanger plate.

According to a further embodiment of the invention, each of said second heat exchanger plates includes a lower surface area, which extends around said first porthole between the first porthole and the upper surface area, wherein the lower surface area is located at the level of the second lower plate plane. The hole of the inlet nozzle may then extend through the lower surface area.

According to a further embodiment of the invention each of said first heat exchanger plates includes a lower surface area, which extends around said first porthole and which delimits said separate space, wherein the lower surface area is located at the level of the lower plate plane. The upper surface area of said second heat exchanger plates may then be located partly opposite to the lower surface area of said first heat exchanger plates for forming said separate space between these areas. In order to create a passage into said separate space, the inlet nozzle may be located opposite to the lower surface area of said first heat exchanger plates. In order to create a passage from said separate space into said first plate interspace, the outlet nozzle may, with regard to the extension plane, be displaced in relation to the lower surface area of said first heat exchanger plates.

According to a further embodiment of the invention, each of said first heat exchanger plates includes an upper surface area, which extends around said first porthole between the first porthole and the lower surface area, wherein the upper surface area is located at the level of the upper plate plane. Furthermore, the lower surface area of said second heat exchanger plates may be located partly opposite to the upper surface area of said first heat exchanger plates, wherein these two surface areas partly abut each other in the plate package.

According to a further embodiment of the invention, said first plate interspaces form first passages for a cooling agent and said second plate interspaces form second passages for a fluid, which is adapted to be cooled by the cooling agent. The plate heat exchanger may then advantageously be adapted to operate as an evaporator.

According to a further embodiment of the invention, substantially each exchanger plate has at least a third porthole and a fourth porthole, which extend through the plate package, wherein the third portholes form a second inlet channel to the second plate interspaces and the fourth portholes form a second outlet channel from the second plate interspaces.

According to a further embodiment of the invention, said heat exchanger plates in the plate package are connected to each other through brazing.

According to a further embodiment of the invention, said separate space is delimited by means of at least one ring, which extends around the inlet channel. Each of said rings may then be provided in a ring groove in the adjacent heat exchanger plate.

BRIEF DESCRIPTION OF THE DRAWINGS

The present invention is now to be explained more closely by means of a description of various embodiments disclosed by way of example, and with reference to the drawings attached hereto.

DETAILED DESCRIPTION OF VARIOUS EMBODIMENTS OF THE INVENTION

Figure 1:
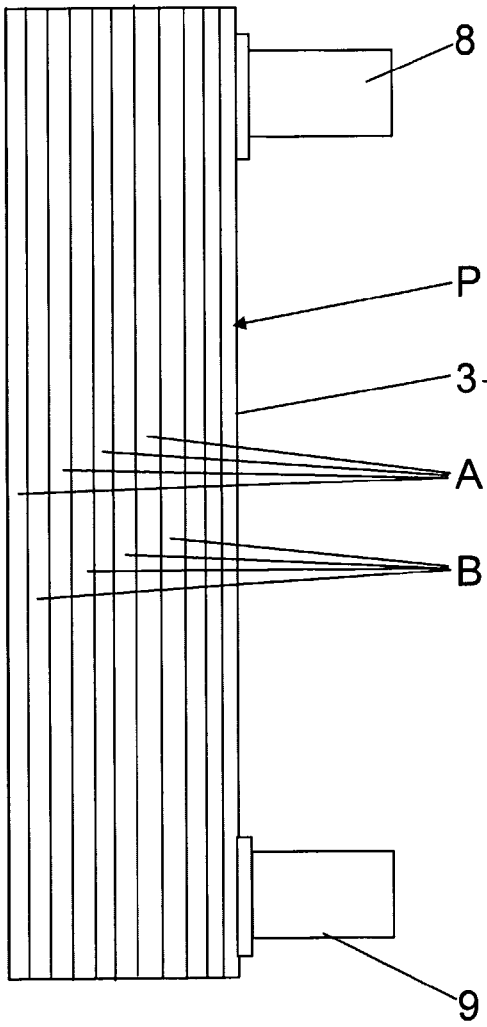
FIG. 1 discloses schematically a side view of a plate heat exchanger according to an embodiment of the invention.
Figure 2:
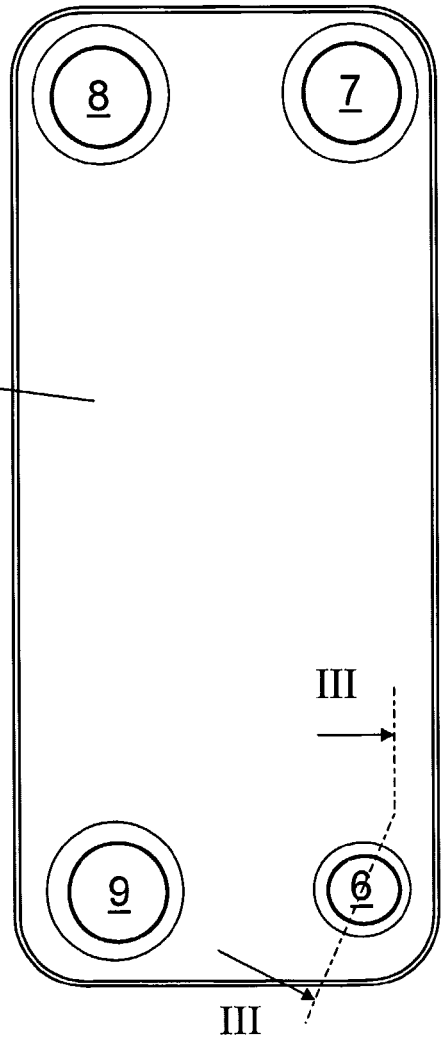
FIG. 2 discloses schematically a front view of the plate heat exchanger in FIG. 1.
Figure 3:
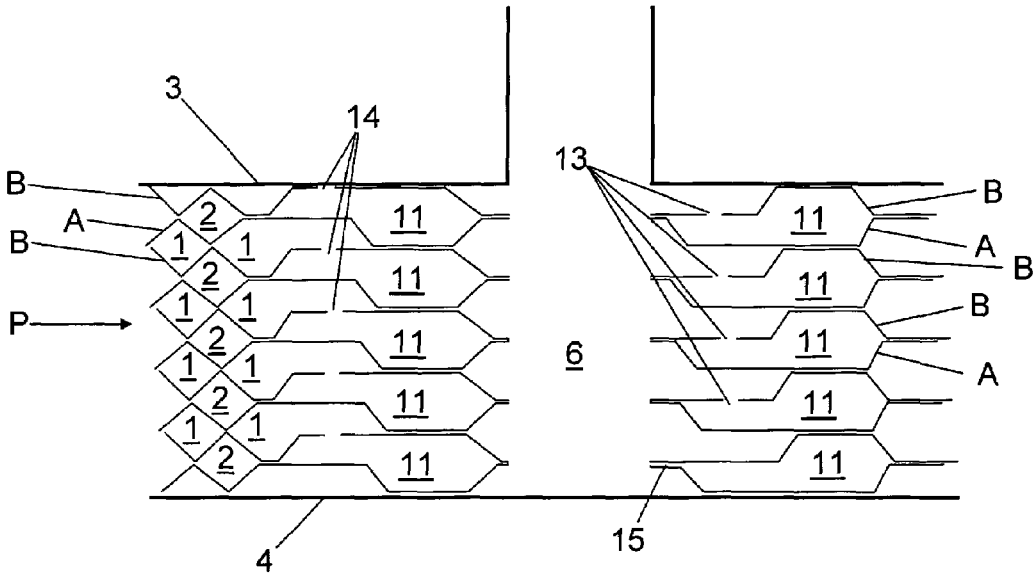
FIG. 3 discloses schematically a sectional view along the line III-III in FIG. 2.
Figure 4:
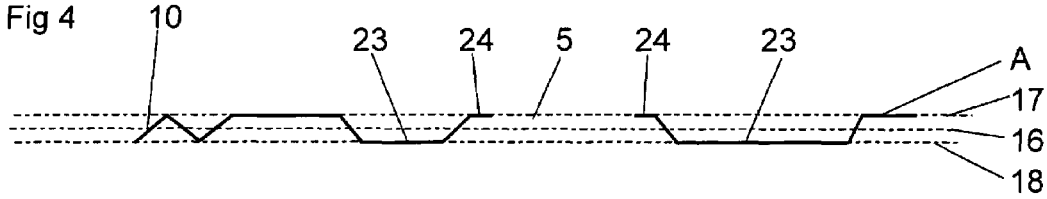
FIG. 4 discloses schematically a side view of a first heat exchanger plate of the plate heat exchanger in FIG. 1.
Figure 5:
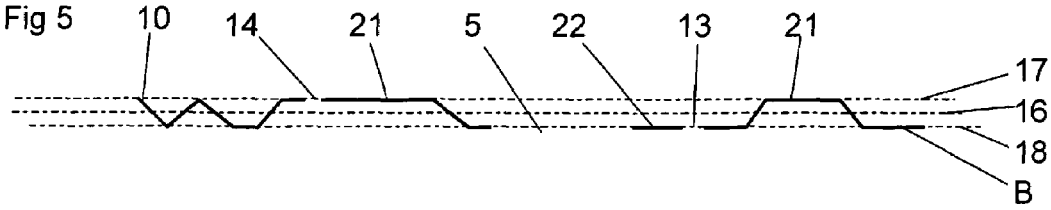
FIG. 5 discloses schematically a side view of a second heat exchanger plate of the plate heat exchanger in FIG. 1.

FIGS. 1 to 3 disclose a possible embodiment of the plate heat exchanger according to the invention. The plate heat exchanger includes a plate package P, which is formed by a number of compression-moulded heat exchanger plates A, B, which are provided beside each other. The heat exchanger plates include in the embodiment disclosed two different plates, which in the following are called the first heat exchanger plates A, see FIGS. 3, 4 and 6, and the second heat exchanger plate B, see FIGS. 3, 5 and 7. As is clear the plate package P includes substantially the same number of first heat exchanger plates A and second heat exchanger plates B.

As is clear from FIG. 3, the heat exchanger plates A, B are provided beside each other in such a way that a first plate interspace 1 is formed between each pair of adjacent first heat exchanger plates A and second heat exchanger plates B, and a second plate interspace 2 between each pair of adjacent second heat exchanger plates B and first heat exchanger plates A. Every second plate interspace thus forms a respective first plate interspace 1 and the remaining plate interspaces form a respective second plate interspace 2, i.e. the first and second plate interspaces 1 and 2 are provided in an alternating order in the plate package P. Furthermore, the first and second plate interspaces 1 and 2 are substantially completely separated from each other.

The plate heat exchanger according to the invention may advantageously be adapted to operate as an evaporator in a cooling agent circuit, not disclosed. In such an evaporator application, the first plate interspaces 1 may form first passages for a cooling agent whereas the second plate interspaces 2 form second passages for a fluid, which is adapted to cooled by the cooling agent.

The plate package P also includes an upper sealing plate 3 and a lower sealing plate 4, which are provided on a respective side of the plate package P and form the end plates of the plate package. In the embodiment disclosed, the heat exchanger plates A, B and the sealing plates 3, 4 are permanently connected to each other. Such a permanent connection may advantageously be performed through brazing. Other possible connection techniques include welding and gluing. However, it is also possible to apply the invention to plate heat exchangers where the plate package P is kept together by tie-bolts extending through the heat exchanger plates A, B and the sealing plates 3, 4.

Figure 6:
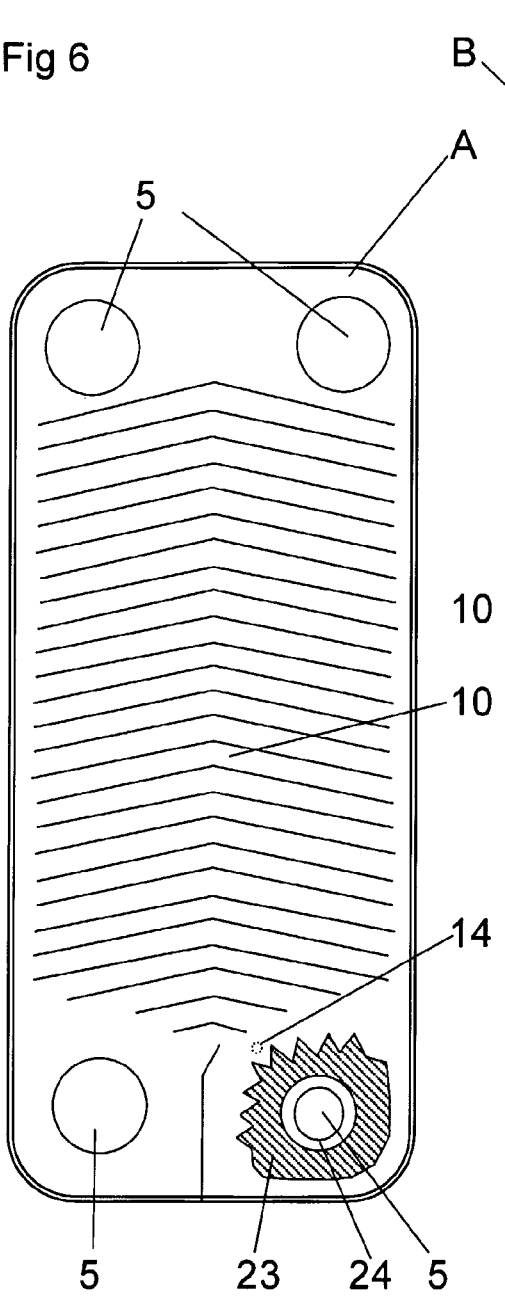
FIG. 6 discloses schematically a view from above of the first heat exchanger plate in FIG. 4.
Figure 7:
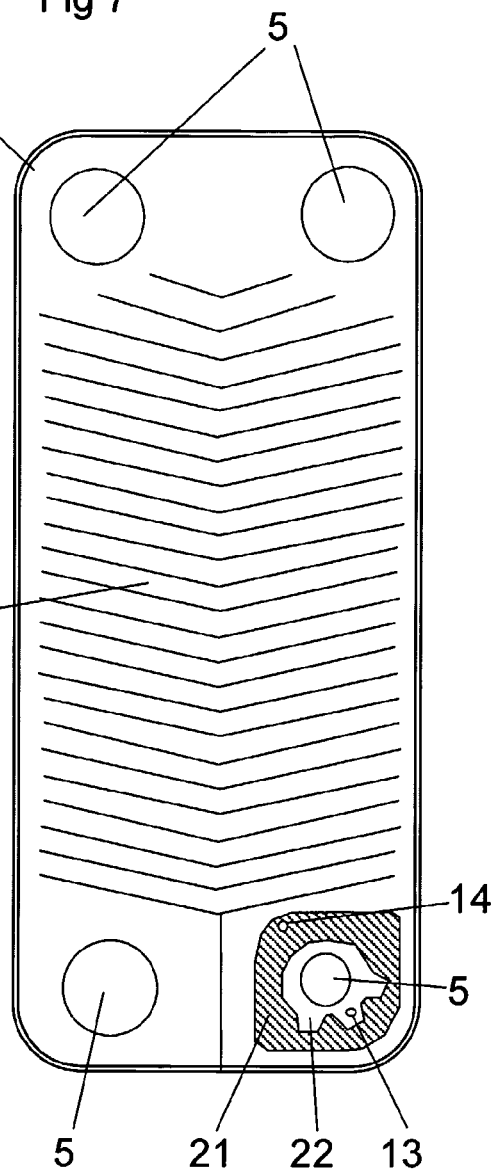
FIG. 7 discloses schematically a view from above of the second heat exchanger plate in FIG. 5.

As appears from especially FIGS. 2, 6 and 7, substantially each heat exchanger plate A, B has four portholes 5, namely a first porthole 5, a second porthole 5, a third porthole 5 and a fourth porthole 5. The first portholes 5 form a first inlet channel 6 to the first plate interspaces 1, which extends through substantially the whole plate package P, i.e. all plates A, B and 3 except for the sealing plate 4. The second portholes 5 form a first outlet channel 7 from the first plate interspaces 1, which also extends through substantially the whole plate package P, i.e. all plates A, B and 3 except for the sealing plate 4. The third portholes 5 form a second inlet channel 8 to the second plate interspaces 2, and the fourth portholes 5 form a second outlet channel 9 from the second plate interspaces 2. Also these two channels 8 and 9 extend through substantially the whole plate package P, i.e. all plates A, B and 3 except for the sealing plate 4. The four portholes 5 are provided in the proximity of a respective corner of the substantially rectangular heat exchanger plates A, B. In a central area of each heat exchanger plate A, B there is an active heat transfer area 10, which is provided with a corrugation of ridges and valleys in a manner known per se. In the embodiment disclosed the corrugations extend in a herringbone-like pattern, wherein the corrugations of the first heat exchanger plates A point in a direction and the corrugations of the second heat exchanger plates B point in the opposite direction. The heat transfer area 10 may of course have other kinds of patterns.

The heat exchanger plates A and B are compression-moulded in such a way that a separate space 11 is formed around the first inlet channel 6. Each separate space 11 is substantially completely closed to the second plate interspaces 2. As is clear from FIG. 3, each separate space 11 is provided between a respective pair of adjacent second heat exchanger plates B and first heat exchanger plates A, i.e. the separate spaces 11 are provided between the same pair of the heat exchanger plates B and A as the second plate interspaces 2.

Figure 8:
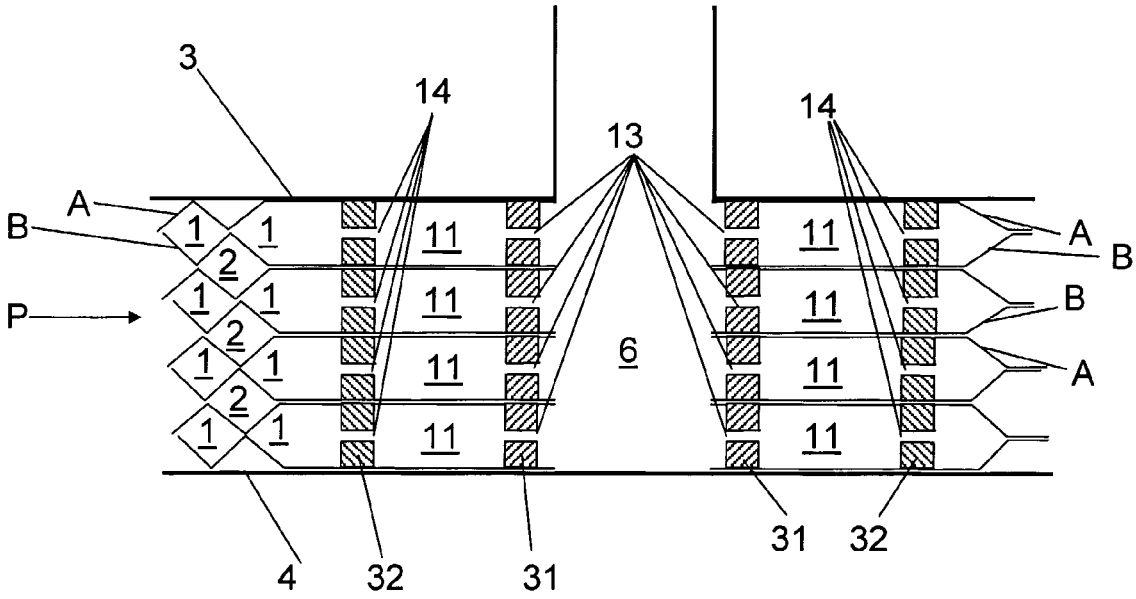
FIG. 8 discloses schematically a sectional view similar to the one in FIG. 3 of another embodiment of the invention.

It is to be noted here that the invention also may be performed by means of non compression-moulded, i.e. substantially plane heat exchanger plates. In such a variant, the separate spaces 11 may be produced by means of rings 31, 32 located between the heat exchanger plates A, B, see FIG. 8. For instance there may be such an inner ring 31 immediately outside the inlet channel and a second outer ring 32 somewhat outside the first inner ring, wherein the separate space 11 is located between the rings 31, 32. The invention also includes combinations of these solutions, i.e. the separate spaces 11 may be delimited by a delimiting surface, provided through the compression-moulding, and by a ring. Embodiments having one or several rings 31, 32 may also be combined with a compression-moulded central heat transfer area 10 with corrugations having a suitable pattern, see Fig. Furthermore, each heat exchanger plate A, B may be provided with one or two ring grooves for receiving one or both rings 31 and 32, in such a way that each of said rings 31, 32 are provided in a ring groove in the adjacent heat exchanger plate A, B.

Each such separate space 11 communicates with the first inlet channel 6 and with a respective one of the first plate interspaces 1. Each separate space 11 communicates with the first inlet channel 6 via an inlet nozzle forming a throttling having a significantly reduced flow area. Each separate space 11 communicates with a respective first plate interspace 1 via an outlet nozzle forming a throttling with a significantly reduced flow area. The flow area of the two nozzles is thus significantly reduced in comparison with the flow area of the first inlet channel 6 and in comparison with the flow area of each of the first plate interspaces 1. In the embodiment disclosed, the inlet nozzle is formed by a hole 13 extending through each second heat exchanger plate B. The outlet nozzle is formed in a corresponding manner by a hole 14, extending through each second heat exchanger plate B. In the embodiment disclosed, the cooling agent is thus conveyed from the first inlet channel 6 through the holes 13 in the separate spaces 11 and from there through the holes 14 out into the first plate interspaces 1. Thanks to the fact that the holes 13 and 14 thus lie in series with each other, a larger pressure drop may be provided than if merely one throttling is used, since there is a practical delimit for how small the hole may be made. Too small holes lead to a risk that the holes are clogged, for instance in connection with the brazing of the plate package.

The holes 13 and 14 disclosed may in an easy manner be manufactured with a desired flow area so that a sufficient throttling and thus a sufficient pressure drop is obtained. The holes 13-14 have a diameter, which may vary with the actual application. For instance, the holes 13, 15 may have a diameter, which is less than or equal to 9 mm, preferably less than or equal to 7 mm or more preferably less than or equal to 5 mm. The diameter of the holes 13, 14 is preferably larger than or equal to 1 mm.

In the case that the separate space 11 is delimited by one or several rings 31, 32 as explained above, these rings 31, 32 may include corresponding holes 13, 14 for forming inlet and/or outlet nozzles.

The inlet nozzle and the outlet nozzle may also be formed in another way than through a respective hole extending through the B-plate. For instance, as an alternative, a small passage 15, see FIG. 3, between an adjacent first heat exchanger plate A and a second heat exchanger plate B may be provided in connection with the moulding of the second heat exchanger plate B. In this case, the cooling agent will flow into the separate space 11 via the passage 15 and out of the separate space 11 into the first plate interspace 1 via the hole 14. Also the hole 14 may in an alternative way be designed as a thin passage between the first heat exchanger plate A and the second heat exchanger plate B. In this latter case, the second passages 2 will however receive the cooling agent whereas the first passages 1 receive the fluid cooling the cooling agent. The thin passage 15 may have a cross-sectional diameter or cross-sectional size corresponding to the diameter defined above for the holes 13 and 14.

The design of the heat exchanger plates, i.e. the first heat exchanger plate A and the second heat exchanger plate B in the embodiment disclosed, is now to be described more closely in particular with reference to FIGS. 4-7. Each of the heat exchanger plates A, B extends along a central extension plane 16. The heat exchanger plates A, B are compression-moulded in such a way that they extend from the central extension plane to an upper plate plane 17 on one side of the central extension plane 16 and to a lower plate plane 18 on the other side of the central extension plane 16.

Each of the heat exchanger plates B includes an upper surface area 21, which extends around the first porthole 5. The upper surface area 21 is located at the level of the upper plate plane 17. Each of the second heat exchanger plates B also includes a lower surface area 22, which extends around the first porthole 5 and the upper surface area 21. The lower surface area 21 is located at the level of the lower plate plane 18.

Each of the first heat exchanger plates A includes a lower surface area 23, which extends around the first porthole 5. The lower surface area 23 is located at the level of the lower plate plane 18. Each of the first heat exchanger plates A also includes an upper surface area 24, which extends around the first porthole 5 and is located between the first porthole 5 and the lower surface area 23. The upper surface area 24 is located at the level of the upper plate plane 17.

The upper surface area 21 of the second heat exchanger plates B is located partly opposite to the lower surface area 23 of the first heat exchanger plates A for forming the separate space 11 between these surface areas 21 and 23. Furthermore, the lower surface area 22 of the second heat exchanger plates B is partly located opposite to the upper surface area 24 of the first heat exchanger plates A. These two surface areas 22 and 24 will thus partly abut each other in the plate package P in such a way that the separate space 11 is closed to the first inlet channel 6 except via the hole 13 or the thin passage 15.

The hole 13 of the inlet nozzle extends through the lower surface area 22 of the second heat exchanger plates B and is located opposite to the lower surface 23 of the first heat exchanger plates A. The hole 14 of the outlet nozzle extends through the upper surface area 21 of the second heat exchanger plates P and is with regard to the central extension 16 displaced in relation to the second surface area 23 of the first heat exchanger plates A. The position of the hole 14 in relation to the first heat exchanger plate A is indicated in FIG. 6. Since the hole 14 is located at the level of the upper plate plane 17, the hole 14 of the uppermost or outermost second heat exchanger plate B will in an easy manner be closed by the upper sealing plate 3 when the plate package P has been mounted.

The separate space 11 will thus be delimited by the upper surface area 21 of the second heat exchanger plates B and the lower surface area 23 of the first heat exchanger plates A. The separate space is delimited to the inlet channels 6 by the lower surface area 22 and the upper surface area 24, which abut each other in the plate package P.

The invention is not limited to the embodiment disclosed but may be varied and modified within the scope of the following claims, which partly has been described above.

The invention claimed is:

1. A plate heat exchanger comprising a plate package, the plate package including a number of first heat exchanger plates and a number of second heat exchanger plates, the plates being permanently joined to each other and arranged beside each other so that a first plate interspace is formed between each pair of adjacent first heat exchanger plates and second heat exchanger plates, and so that a second plate interspace is formed between each pair of adjacent second heat exchanger plates and first heat exchanger plates, wherein the first plate interspaces and the second plate interspaces are separated from each other and provided beside each other in an alternating order in the plate package, wherein substantially each heat exchanger plate has at least a first porthole and a second porthole, the first portholes forming a first inlet channel to the first plate interspaces and the second portholes forming a first outlet channel from the first plate interspaces, wherein the plate package includes a separate space for each of the first plate interspaces, which space is closed to the second plate interspaces, wherein the separate space communicates with the first inlet channel via an inlet nozzle, which forms a throttling with significantly reduced flow area, and with the respective first plate interspace via an outlet nozzle, which forms a throttling with significantly reduced flow area, wherein the separate space has been produced through compression-molding of the heat exchanger plates, and wherein the inlet nozzle and the outlet nozzle are each formed by a respective hole, which extends through each of the second heat exchanger plates.

2. A plate heat exchanger according to claim 1, wherein the separate space is provided in the proximity of the inlet channel.

3. A plate heat exchanger according to claim 1, wherein the separate space is provided between a respective pair of adjacent second heat exchanger plates and first heat exchanger plates.

4. A plate heat exchanger according to claim 1, wherein each of the heat exchanger plates includes a central extension plane, an upper plate plane on one side of the central extension plane and a lower plate plane on the other side of the central extension plane.

5. A plate heat exchanger according to claim 4, wherein each of the second heat exchanger plates includes an upper surface area, which extends around the first porthole and which delimits the separate space, and the upper surface area is located at the level of the upper plate plane.

6. A plate heat exchanger according to claim 5, wherein the hole of the outlet nozzle extends through the upper surface area.

7. A plate heat exchanger according to claim 6, wherein the heat exchanger includes an end plate, which is provided adjacent to one of the second heat exchanger plates and closes the hole of the outlet nozzle of this second heat exchanger plate.

8. A plate heat exchanger according to claim 5, wherein each of the second heat exchanger plates includes a lower surface area, which extends around the first porthole between the first porthole and the upper surface area, wherein the lower surface area is located at the level of the lower plate plane.

9. A plate heat exchanger according to claim 8, wherein the hole of the inlet nozzle extends through the lower surface area.

10. A plate heat exchanger according to claim 8, wherein each of the first heat exchanger plates includes a lower surface area, which extends around the first porthole and which delimits the separate space, and the lower surface area is located at the level of the lower plate plane.

11. A plate heat exchanger according to claim 5, wherein the upper surface area of the second heat exchanger plates is located partly opposite to the lower surface area of the first heat exchanger plates for forming the separate space between these surface areas.

12. A plate heat exchanger according to claim 11, wherein the inlet nozzle is located opposite to the lower surface area of the first heat exchanger plates.

13. A plate heat exchanger according to claim 12, wherein the outlet nozzle, with regard to the central extension plane, is displaced in relation to the lower surface area of the first heat exchanger plates.

14. A plate heat exchanger according to claim 10, wherein each of the first heat exchanger plates includes an upper surface area, which extends around the first porthole between the first porthole and the lower surface area, wherein the upper surface area is located at the level of the upper plate plane.

15. A plate heat exchanger according to claim 14, wherein the lower surface area of the second heat exchanger plates is located partly opposite to the upper surface area of the first heat exchanger plates, wherein these two surface areas partly abut each other in the plate package.

16. A plate heat exchanger according to claim 1, wherein the first plate interspaces form first passages for a cooling agent and the second plate interspaces form second passages for a fluid, which is adapted to be cooled by the cooling agent.

17. A plate heat exchanger according to claim 1, wherein substantially each heat exchanger plate has at least a third porthole and a fourth porthole, which extend through the plate package, wherein the third portholes form a second inlet channel to the second plate interspaces and the fourth portholes form a second outlet channel from the second plate interspaces.

18. A plate heat exchanger according to claim 1, wherein the heat exchanger plates in the plate package are connected to each other through brazing.

19. A plate heat exchanger comprising a plate package, the plate package including a number of first heat exchanger plates and a number of second heat exchanger plates, the plates being permanently joined to each other and arranged beside each other so that a first plate interspace is formed between each pair of adjacent first heat exchanger plates and second heat exchanger plates, and so that a second plate interspace is formed between each pair of adjacent second heat exchanger plates and first heat exchanger plates, wherein the first plate interspaces and the second plate interspaces are separated from each other and provided beside each other in an alternating order in the plate package, wherein substantially each heat exchanger plate has at least a first porthole and a second porthole, the first portholes forming a first inlet channel to the first plate interspaces and the second portholes forming a first outlet channel from the first plate interspaces, wherein the plate package includes a separate space for each of the first plate interspaces, which space is closed to the second plate interspaces, wherein the separate space communicates with the first inlet channel via an inlet nozzle, which forms a throttling with significantly reduced flow area, and with the respective first plate interspace via an outlet nozzle, which forms a throttling with significantly reduced flow area, wherein each of the heat exchanger plates includes a central extension plane, an upper plate plane on one side of the central extension plane and a lower plate plane on the other side of the central extension plane, wherein each of the second heat exchanger plates includes an upper surface area, which extends around the first porthole and which delimits the separate space, and the upper surface area is located at the level of the upper plate plane, wherein each of the second heat exchanger plates includes a lower surface area, which extends around the first porthole between the first porthole and the upper surface area, wherein the lower surface area is located at the level of the lower plate plane, and wherein the hole of the inlet nozzle extends through the lower surface area.

20. A plate heat exchanger according to claim 19, wherein the separate space is provided in the proximity of the inlet channel.

21. A plate heat exchanger according to claim 19, wherein the separate space has been produced through compression-molding of the heat exchanger plates.

22. A plate heat exchanger according to claim 19, wherein at least one of the nozzles is formed by a respective hole, which extends through each of the second heat exchanger plates.

* * * * *